US006226930B1

(12) United States Patent
Kraatz

(10) Patent No.: US 6,226,930 B1
(45) **Date of Patent: *May 8, 2001**

(54) VARIABLE-VOLUME STORAGE SYSTEM

(75) Inventor: David J. Kraatz, Amherst, NY (US)

(73) Assignee: Sovran Acquisition Limited Partnership, Buffalo, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/404,268

(22) Filed: Sep. 20, 1999

(51) Int. Cl.[7] ..... E04B 1/346; E04B 7/16
(52) U.S. Cl. ..... 52/64
(58) Field of Search ..... 52/64

(56) References Cited

U.S. PATENT DOCUMENTS 4,049,311 * 9/1977 Dietrich ..... 296/24
4,943,110 * 7/1990 Pastva ..... 296/181

* cited by examiner

*Primary Examiner*—Carl D. Friedman
*Assistant Examiner*—Kevin McDermott
(74) *Attorney, Agent, or Firm*—Phillips, Lytle, Hitchcock, Blaine & Huber LLP

(57) ABSTRACT

A storage system (20) has substantially-parallel stationary first and second walls (21, 22) spaced from one another. A third wall (29) is mounted for movement relative to the first and second walls. The improvement comprises track means (26) for guiding movement of the third wall relative to the first and second walls. The track means has a first track (31) mounted on the first wall, a second track (32) mounted on the second wall, a carriage (33) mounted on the third wall and operatively engaging the first track for movement therealong, and a second carriage (40) mounted on the third wall and operatively engaging the second track for movement therealong. The improvement further includes locking means (28) operatively arranged to releasably hold at least one of the carriages to the associated track for preventing unintended movement of the third wall relative to the first and second walls. Thus, the third wall may be releasably held in an adjustable position relative to the first and second walls. In the preferred form, there is a fourth adjustable wall (30) that is structurally similar to the third wall.

7 Claims, 4 Drawing Sheets

VARIABLE-VOLUME STORAGE SYSTEM

TECHNICAL FIELD

The present invention relates generally to the field of rentable storage space, and, more particularly, to an improved storage system in which a storage bay has at least one, and possibly two, movable walls that allow the total volume of available space to be tailored to the specific needs of one or more consumers.

BACKGROUND ARTS

The need for storage space has increased in recent years due to the bulk of goods that must be stored, either long term or short term.

The past decade has also seen the growth of rentable self-storage systems. These are usually in the form of single-storey buildings having access, typically through an upwardly-acting door, to a volume of space therewithin. Usually, there are access doors provided on opposite sides of the building, and the volume of space between two transversely-aligned access doors is separated by an interior partition. In many instances, the partition is fixed and subdivides the total space between the two doors into two fixed volumes. However, this may not be the most efficient way to utilize such available space. For example, one person might wish to store a boat and trailer over the winter, and might need more space than would be afforded by a half of the total door-to-door volume. On the other hand, another person may wish to rent less than a half bay.

Accordingly, there is a need to provide an improved storage system in which the total volume of the rentable space may be selectively and adjustably divided and tailored to the particular needs of the individual consumer.

DISCLOSURE OF THE INVENTION

With parenthetical reference to the corresponding parts, portions or surfaces of the disclosed embodiment, merely for purposes of illustration and not by way of limitation, the present invention broadly provides an improved storage system (20), such as contained within static structures and the like.

In its broad form, the improved storage system has substantially-parallel first and second walls (21, 22) spaced from one another, and has a third wall (29) mounted for movement relative to the first and second walls. The improvement comprises track means (26) for guiding movement of the third wall relative to the first and second walls. The track means has a first track (31) positioned substantially parallel to the first wall, a second track (32) positioned substantially parallel to the second wall, a first carriage (33) mounted on the third wall and operatively engaging the first track for movement therealong, and a second carriage (44) mounted on the third wall and operatively engaging the second track for movement therealong. The improvement also includes locking means (28) operatively arranged to releasably hold at least one of the carriages to the associated track for preventing unintended movement of the third wall relative to the first and second walls; whereby the third wall may be releasably held in an adjustable position relative to the first and second walls such that the total volume of available space may be tailored and partitioned according to the particular needs of the individual consumer.

In the preferred form, the first track is mounted on the first wall, and the second track is mounted on the second wall. Indeed, the first track may comprise two or more parallel tracks, with carriages associated with each. The locking means may include a plurality of recesses (36) on one of the tracks, and a detent (41) mounted on the associated carriage, such that the detent may be selectively engaged with any one of the recesses to prevent unintended movement of the third wall relative to the first and second walls. The detent may be pivotally mounted on the carriage. A keeper may also be mounted on a carriage in association with the detent to accommodate a lock, such as a pad lock, a combination lock or the like, by which the wall may be releasably held in a particular position against unintended movement.

In a particularly preferred form, the locking means is a first locking means, and the improvement further comprises a fourth wall (30) mounted for movement relative to the first and second walls, a third carriage mounted on the fourth wall and engaging the first track, a fourth carriage mounted on the fourth wall and engaging the second track, and second locking means mounted on one of the third and fourth carriages and selectively engageable with the associated track for preventing unintended movement of the fourth wall relative to the first and second walls. This form is particularly preferred because it provides two independently-movable walls between the two doors of back-to-back bays, such that the rentable volumes accessible through the doors may be separately and independently varied.

In the preferred form, each carriage has at least two vertically-spaced rollers, and the associated track is passed between these rollers.

Accordingly, the general objective of the invention is to provide an improved storage system.

Another object is to provide an improved storage system in which the total volume of space between two oppositely-disposed access doors is divided by at least one, and preferably two, interior movable wall partitions such that the rentable space accessible through each door may be separately and independently varied.

These and other objects and advantages will become apparent from the foregoing and ongoing written specification, the drawings, and the appended claims.

DESCRIPTION OF THE PREFERRED EMBODIMENT(S)

Figure 1:
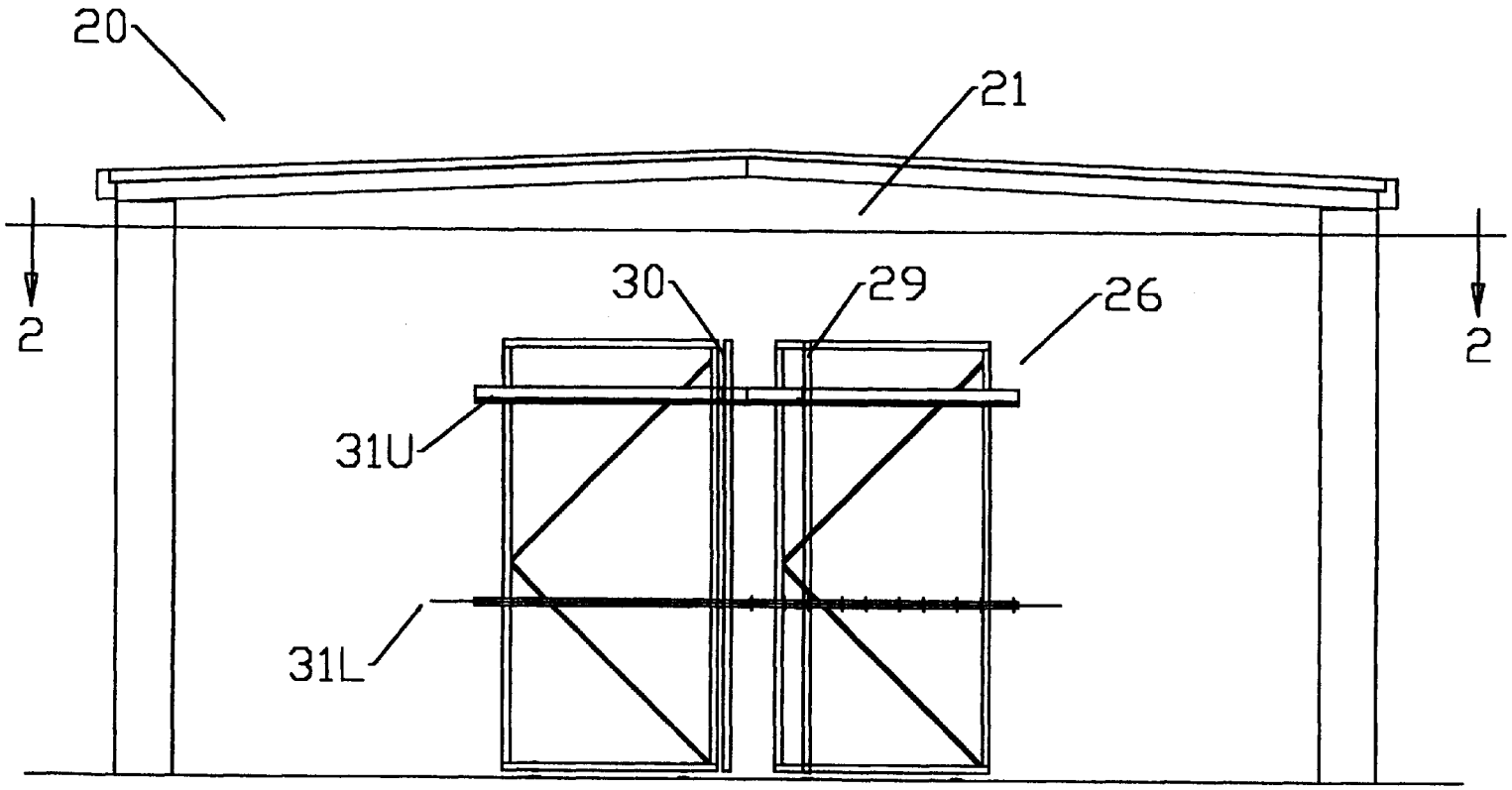
FIG. 1 is a fragmentary view, partly in elevation and partly in vertical section, of a static structure, and particularly showing upper and lower tracks mounted on one interior partition wall.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Figure 2:
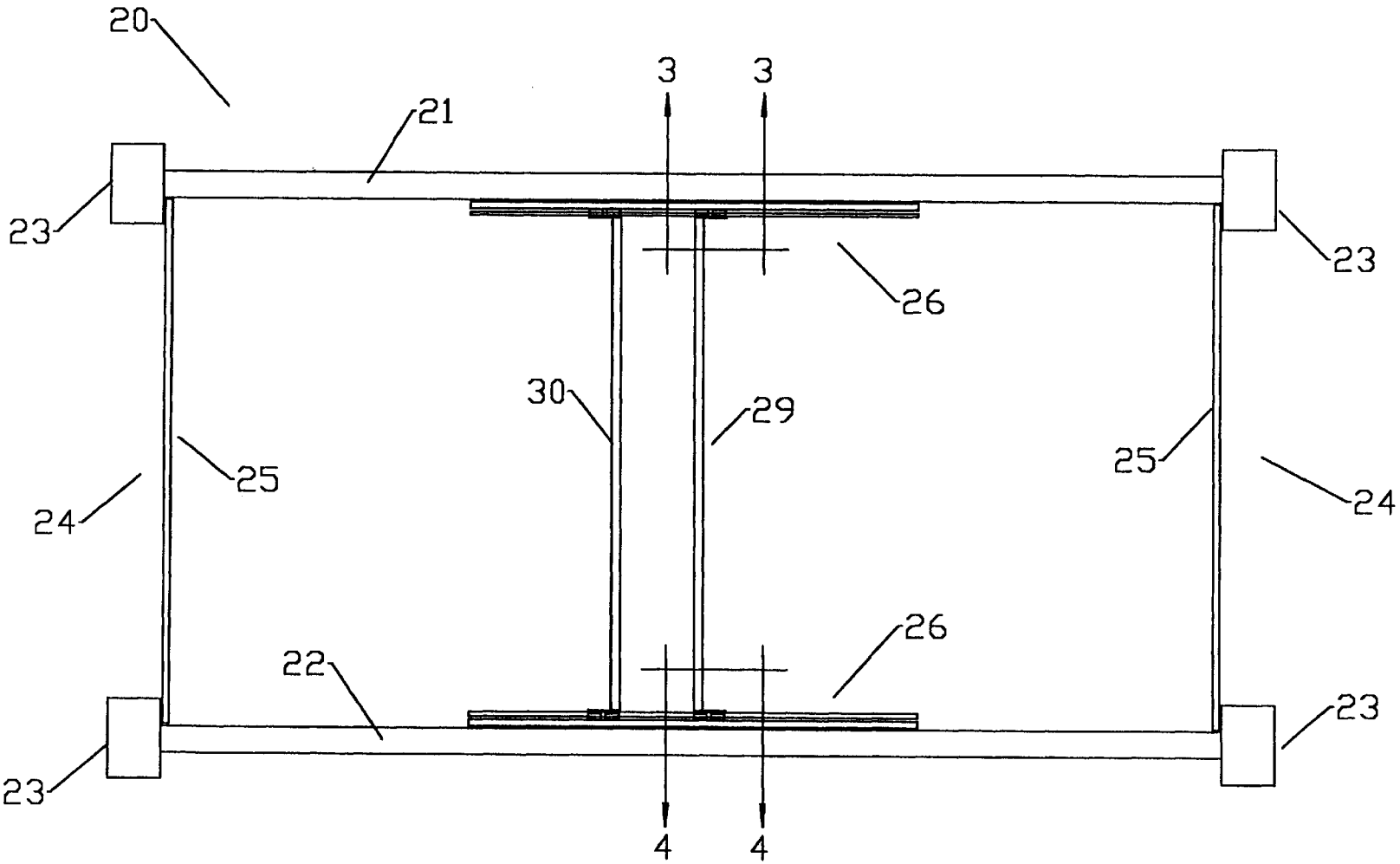
FIG. 2 is a fragmentary horizontal sectional view thereof, taken generally on line 2—2 of FIG. 1, showing one portion of the storage system of FIG. 1 in which two movable walls are operatively mounted on the tracks within back-to-back bays.

Referring now to the drawings, and more particularly, to FIGS. 1 and 2 thereof, the present invention broadly provides an improvement in a storage system, such as generally indicated by static structure or building 20. As best shown in FIG. 2, this building, which is of abbreviated length for clarity of illustration, has two horizontally-spaced substantially parallel walls 21, 22, respectively. These two walls extend between vertical support posts, severally indicated at 23. The space between adjacent longitudinally-spaced posts defines an opening, indicated at 24, that leads to the space or volume defined by parallel side walls 21, 22. These openings are closed by doors, 25.

Figure 3:
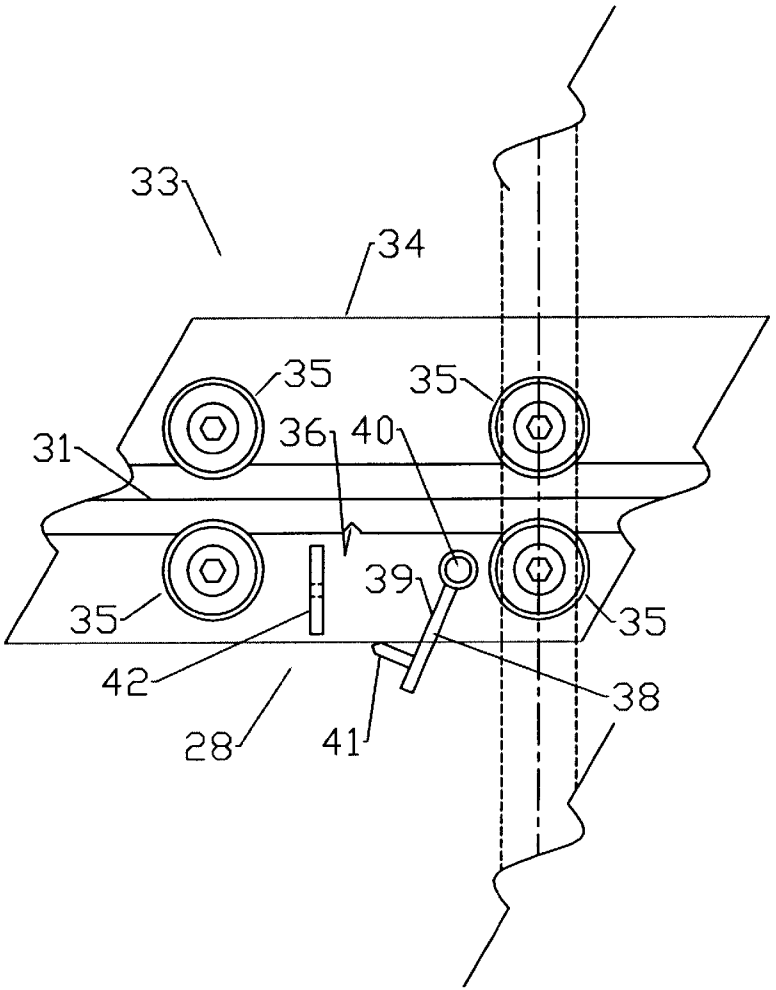
FIG. 3 is a fragmentary vertical sectional view thereof, taken generally on line 3—3 of FIG. 2, showing a carriage as being operatively mounted on one of the tracks for movement therealong.

The invention provides an improvement in the form of track means, generally indicated at 26, and locking means, generally indicated at 28 (FIG. 3). In the improved storage system, third and fourth walls, 29, 30, respectively, are operatively mounted on track means 26 for movement therealong relative to the first and second walls.

Figure 4:
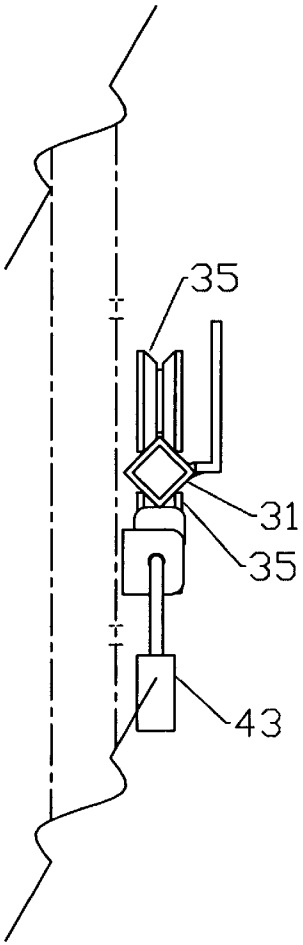
FIG. 4 is a fragmentary view thereof, partly in elevation and partly in vertical section, taken generally on line 4—4 of FIG. 3, of the structure shown in FIG. 3 in section and in elevation.

As best shown in FIGS. 3 and 4, the first track, indicated at 31, is shown as being a horizontally-elongated hollow square tube which has been oriented such that its apices are arranged vertically opposite one another. The first track means is preferably mounted on first wall 21. In the embodiment, shown in FIG. 1 the first track means includes two tracks, an upper and lower track, severally indicated at 31 and individually identified by the suffixes "U" and "L" for upper and lower, respectively. The axes of the upper and lower tracks are parallel to one another.

Figure 6:
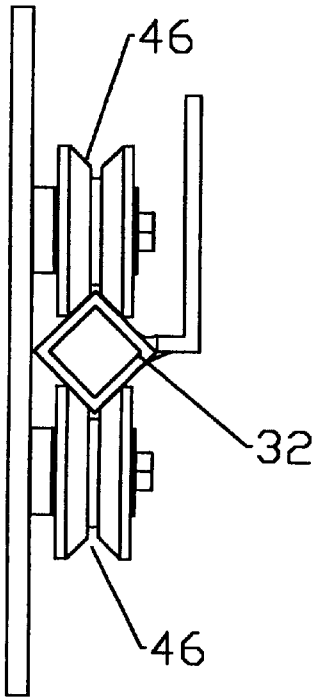
FIG. 6 is a fragmentary view thereof, partly in elevation and partly in vertical section, taken generally on line 6—6 of FIG. 5.
Figure 5:
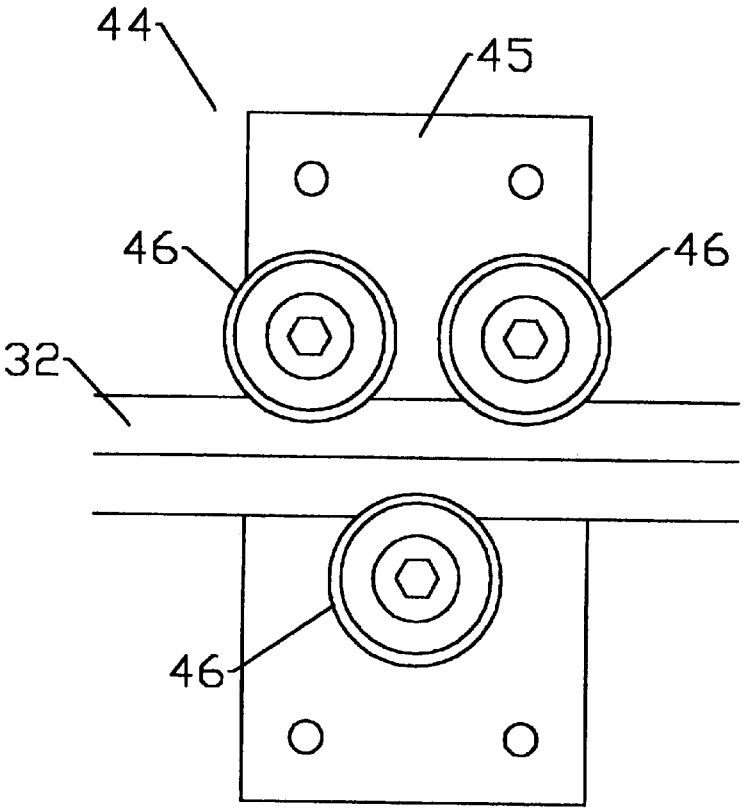
FIG. 5 is a fragmentary vertical sectional view thereof, taken generally on line 5—5 of FIG. 2, showing the second carriage.

As best shown in FIGS. 5 and 6, the second track means includes a second track, generally indicated at 32 that is operatively mounted on the second wall. Here again, the second track is in the form of a horizontally-elongated square hollow tube which is also oriented that such its apices are vertically disposed. The second track is suitably mounted on the second wall 22.

Referring now to FIGS. 3 and 4, a first carriage, generally indicated at 33, is operatively mounted on the third wall 29, and is operatively engaged with the first track for movement therealong. This third carriage is shown as including a plate-like portion 34 Four freely-rotatable rollers, severally indicated at 35, are mounted on this plate-like portion in two vertically-spaced pairs. The first track 31 is adapted to be captured and passed between the two pairs of rollers. Hence, the third panel is restrained from vertical movement relative to the first and second walls. A plurality of notch-like recesses, severally indicated at 36, are provided in the underside of the first track. A detent mechanism, generally indicated at 38, is mounted on the first carriage. More particularly, this detent has an arm 39 pivotally mounted, as indicated at 40, on the plate. A lug 41 extends outwardly from arm 39 and functions as a detent that is adapted to be received in any one of recesses 36. A keeper 42 is arranged close to the lug 41. Keeper 42 and lug 41 have aligned holes to accommodate passage of the hook portion of a combination lock, indicated at 43.

Adverting now to FIGS. 5 and 6, the second carriage, generally indicated at 44, is shown as having a rectangular plate-like portion 45 that is mounted on the second wall 22. This second carriage has three freely-rotatable rollers, severally indicated at 46. These rollers are arranged such that two of the rollers will engage the upper surface of second track 32, and the other roller will engage the under surface thereof. Since the locking mechanism is provided on the first carriage in this form, there is no need for a second locking mechanism on the second carriage.

In the preferred embodiment, the total volume of space between the four posts 23,23,23,23 is thus subdivided by two movable walls 29,30. The two walls may be moved separately and independently of one another so as to vary the volume of space that may be accessed through each opening 24, 24. Each movable wall has a first carriage mounted on the first track, and has a second carriage mounted on the second track for movement therealong. A locking means is operatively arranged to releasably hold one of the carriages to the associated track for preventing unintended movement of the associated wall relative to the stationary side walls.

The present invention contemplates that many changes and modifications may be made. For example, while the preferred form is shown as having a simply detent-and-recess connection for locking the third and four walls against unintended movement relative to the tracks, other forms and mechanisms may be readily substituted therefore. For example, arm 39 might possibly carry an elastomeric member that might frictionally engage the track. This would avoid the need for notching the track sections. Moreover, it should be readily apparent that the tracks may be readily changed or modified, both as length and in cross-section, as desired, and other types of roller-mechanisms may be provided to facilitate movement of the third and fourth walls therealong. In the preferred embodiment, there are two vertically-spaced first tracks and two vertically-spaced second tracks mounted on the first and second walls, respectively. However, in an alternative embodiment, a greater or lesser number of such tracks might be provided.

Therefore, while the preferred form of the improved storage system has been shown and described, and several modifications thereof discussed, persons skilled in this art will readily appreciate that various additional changes and modifications may be made without departing from the spirit of the invention, as defined and differentiated by the following claims.

What is claimed is:

1. In a storage system having substantially-parallel first and second walls spaced from one another, and having a third wall mounted for movement relative to said first and second walls, the improvement which comprises:

track means for guiding movement of said third wall relative to said first and second walls, said track means having a first track positioned substantially parallel to said first wall;

a second track positioned substantially parallel to said second wall;

a first carriage mounted on said third wall and operatively engaging said first track for movement therealong; and a second carriage mounted on said third wall and operatively engaging said second track for movement therealong; and locking means operatively arranged to releasably hold one of said carriages to the associated track for preventing unintended movement of said third wall relative to said first and second walls, said locking means including a plurality of recesses on one of said tracks and including a detent mounted on the associated carriage, and wherein said detent is arranged to be selectively engaged in one of said recesses to prevent unintended movement of said third wall relative to said first and second walls;

whereby said third wall may be releasably held in an adjustable position relative to said first and second walls so that the total volume of potentially-available space may be tailored to the particular needs of the consumer using such space.

2. The improvement as set forth in claim 1 wherein said first track is mounted on said first wall.

3. The improvement as set forth in claim 1 wherein said second track is mounted on said second wall.

4. The improvement as set forth in claim 1 wherein said detent is pivotally mounted on said associated carriage.

5. The improvement as set forth in claim 4 and further comprising a keeper mounted on said associated carriage to which said detent may be selectively secured.

6. The improvement as set forth in claim 1 wherein said locking means is a first locking means, and wherein the improvement further comprises:

a fourth wall mounted for movement relative to said first and second walls, a third carriage mounted on said fourth wall and engaging said first track, a fourth carriage mounted on said fourth wall and engaging said second track, and second locking means mounted on one of said third and fourth carriages and selectively engageable with the associated track for preventing unintended movement of said fourth wall relative to said first and second walls.

7. The improvement as set forth in claim 1 wherein each carriage has at least two vertically-spaced rollers, and wherein the associated track is passed between said rollers.

* * * * *